US012110705B2

(12) United States Patent
Bengtsson

(10) Patent No.: US 12,110,705 B2
(45) Date of Patent: Oct. 8, 2024

(54) BRACKET FOR SUPPORTING A WALL ELEMENT AND A SYSTEM FOR SHIELDING AN AREA

(71) Applicant: Troax AB, Hillerstorp (SE)

(72) Inventor: Staffan Bengtsson, Gnosjö (SE)

(73) Assignee: TROAX AB, Hillerstorp (SE)

( * ) Notice: Subject to any disclaimer, the term of this patent is extended or adjusted under 35 U.S.C. 154(b) by 254 days.

(21) Appl. No.: 17/777,812

(22) PCT Filed: Nov. 17, 2020

(86) PCT No.: PCT/EP2020/082354
§ 371 (c)(1),
(2) Date: May 18, 2022

(87) PCT Pub. No.: WO2021/121825
PCT Pub. Date: Jun. 24, 2021

(65) Prior Publication Data

US 2022/0412121 A1 Dec. 29, 2022

(30) Foreign Application Priority Data

Dec. 19, 2019 (EP) ..... 19218001

(51) Int. Cl.
*E04H 17/18* (2006.01)
*E04H 17/16* (2006.01)

(52) U.S. Cl.
CPC ..... *E04H 17/18* (2013.01); *E04H 17/163* (2013.01); *E04H 17/17* (2021.01)

(58) Field of Classification Search
CPC ..... E04H 17/163; E04H 17/17; E04H 17/18
See application file for complete search history.

(56) References Cited

U.S. PATENT DOCUMENTS 7,874,545 B2 * 1/2011 Fumagalli ..... E04H 17/163 256/25
9,371,642 B2 * 6/2016 Herbertsson ..... E04H 17/163
(Continued)

FOREIGN PATENT DOCUMENTS

CN 101205770 A 6/2008
CN 103132632 A 6/2013
(Continued)

OTHER PUBLICATIONS

International Search Report and Written Opinion from corresponding International Application No. PCT/EP2020/082354, mailed on Feb. 5, 2021, 8 pages.

*Primary Examiner* — Michael P Ferguson
(74) *Attorney, Agent, or Firm* — Tucker Ellis LLP

(57) ABSTRACT

Bracket (1) for supporting a wall element (50) between two posts (60) and a system for shielding an area. The bracket (1) which is tube-shaped and arranged to enclose a post (60) comprises a front part (2), a back part (3), and first and second side parts (4, 5). At least one of the first and second side parts (4, 5) comprises a slit (6) with a receiving section (6*a*) open towards the front part (2) and arranged for receiving a protrusion (51) of a wall element (50). The slit (6) comprises a locking section (6*c*) for keeping a protrusion (51) of a wall element (50) in a locked position, and is arranged at a first distance (a) from the receiving section (6*a*) in a first direction (X1) of the bracket (1). The slit (6) comprises a guiding section (6*b*) arranged between the receiving section (6*a*) and the locking section (6*c*) which is arranged for guiding a protrusion (51) from the receiving section (6*a*) to the locking section (6*c*). The system comprises a wall element (50) with lower and upper protrusions (51, 52), two posts (60), an upper bracket (20) provided on respective one of the posts (60) in an upper position, and the
(Continued)

lower bracket (1) provided on respective one of the posts (60) in a lower position.

15 Claims, 7 Drawing Sheets

(56) References Cited

U.S. PATENT DOCUMENTS

| | | | | |
|---|---|---|---|---|
| 2005/0210783 | A1 | 9/2005 | Herbertsson | |
| 2016/0083974 | A1* | 3/2016 | Meza | E04H 17/17 248/219.4 |

FOREIGN PATENT DOCUMENTS

| | | | | | |
|---|---|---|---|---|---|
| CN | 107642278 | A | | 1/2018 | |
| CN | 207420215 | U | | 5/2018 | |
| DE | 32 48 438 | | * | 7/1984 | E04H 17/17 |
| EP | 2602407 | A2 | | 6/2013 | |
| EP | 2757215 | A1 | | 7/2014 | |
| FR | 3077835 | A1 | | 8/2019 | |
| WO | 03106788 | A1 | | 12/2003 | |

* cited by examiner

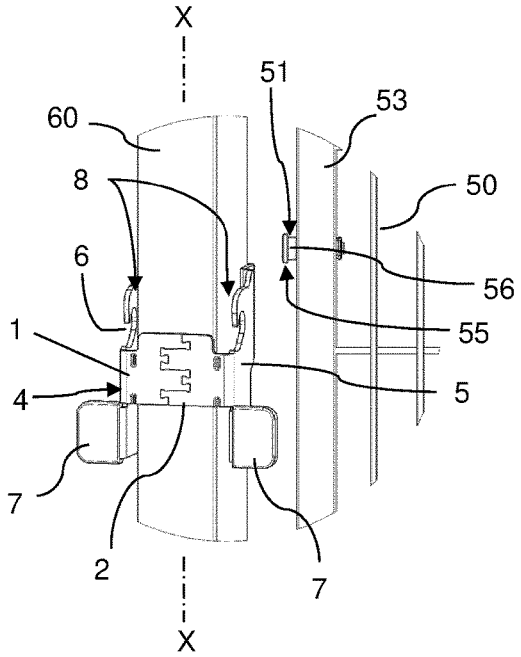
Fig. 4a
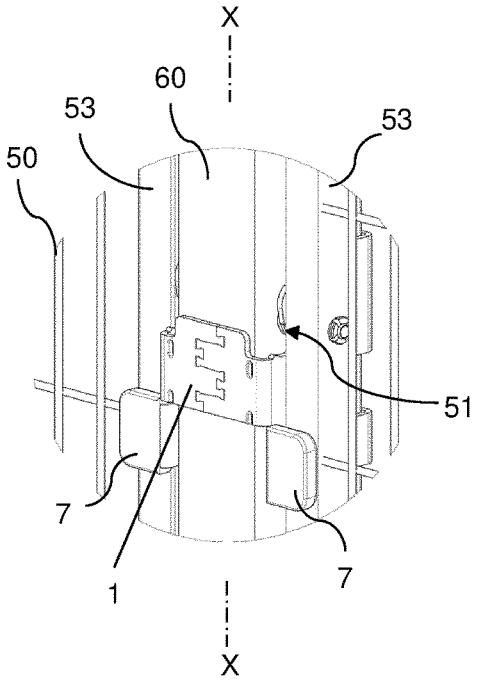
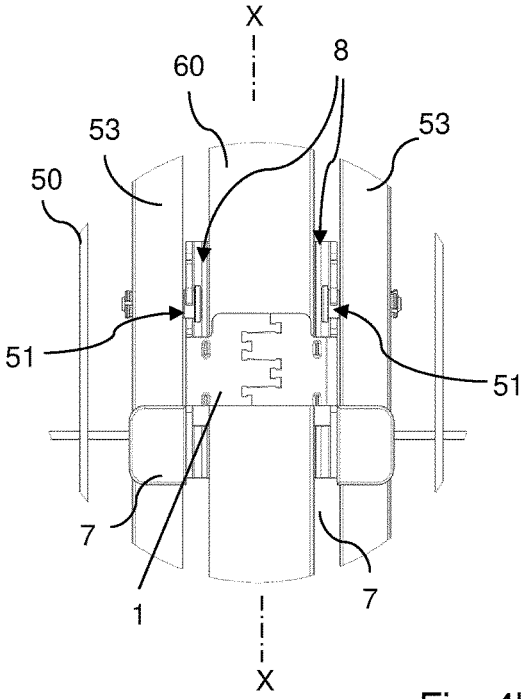
Fig. 4b-c

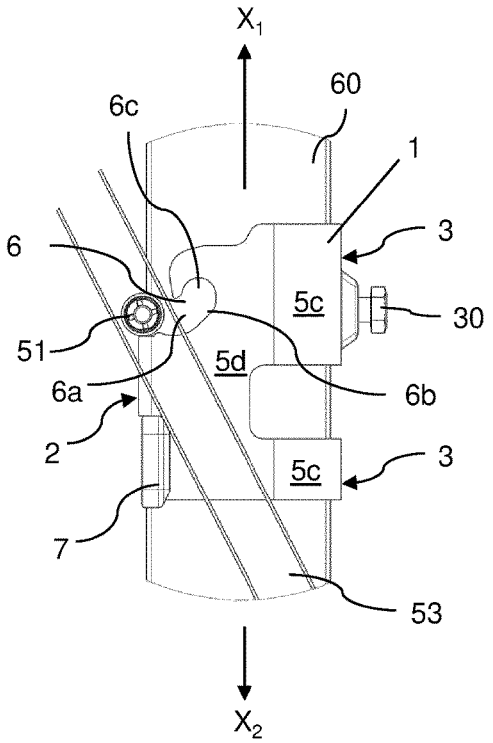
Fig. 5a
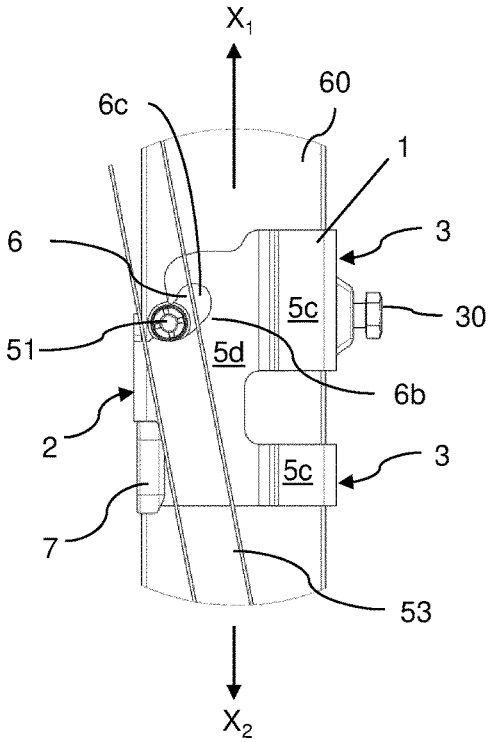
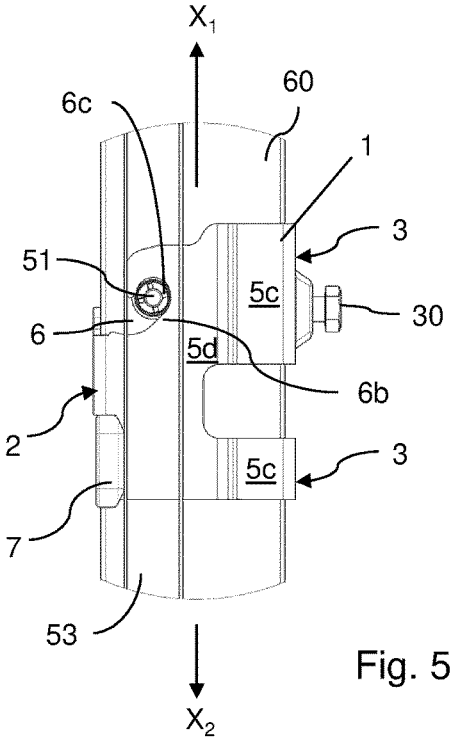
Fig. 5b-c

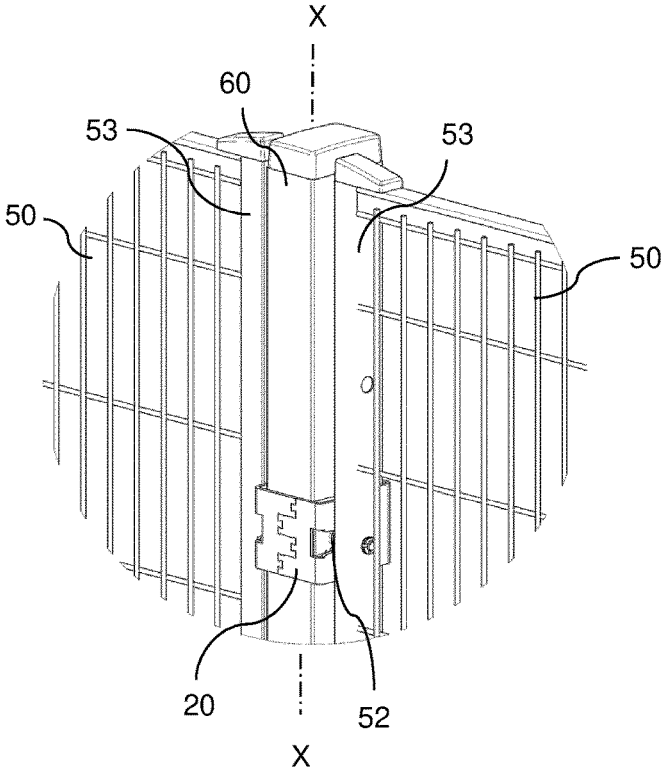
Fig. 7a
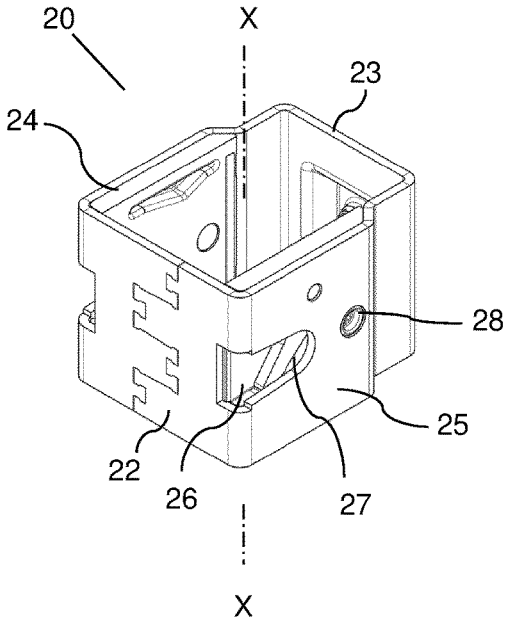
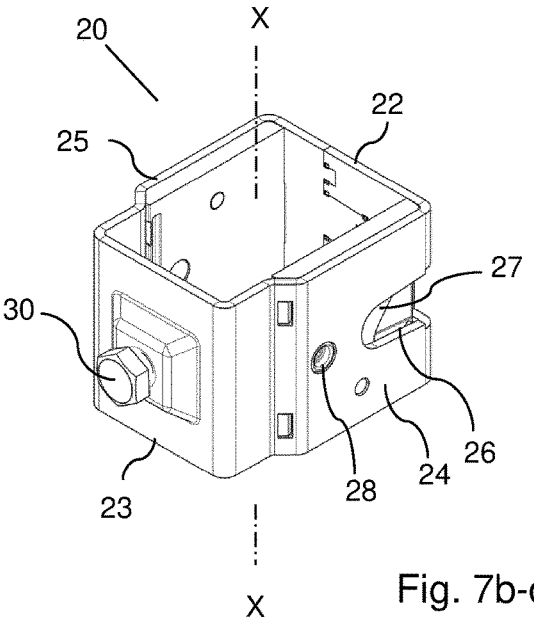
Fig. 7b-c

BRACKET FOR SUPPORTING A WALL ELEMENT AND A SYSTEM FOR SHIELDING AN AREA

TECHNICAL FIELD

The present invention relates generally to a bracket arranged for attachment to a post and arranged for supporting a wall element between two such posts. Further, the present invention relates to a system for shielding of an area, e.g. around machines and the like. The wall element is arrangeable in an unstable readiness position, where the wall element is supported by the bracket arranged on each of the posts such as supporting the wall element below its center of gravity. From this unstable readiness position, the wall element is brought into a locked position by a pivoting motion from a mounting position to a locked position in which the wall element is substantially aligned with the posts. In the locked position, the mounting bracket prevents an accidental lift of the wall element from the locked position, at for example a sudden impact from a heavy load.

BACKGROUND ART

Especially in many of today's industries there is a need to provide shielding, for example around machines. Shielding around machines, so-called machine safeguards, aim to prevent that persons by mistake get into a machine working area and thereby run the risk of getting injured, or to prevent unauthorized persons to control the machine. A machine safeguard may also be used to catch details which are machined, but which are dropped by the machine or a robot which works on the inside of the machine safeguard.

There are a lot of legal requirements which applies to such shielding and machine safeguards. One example of this is that it shall not be possible to open the machine safeguard from the outside without a key or any particular tool. It shall neither be possible to arrange parts of the machine safeguard in a mounted position without them being locked in the above described way. Thus, the machine safeguard shall not be designed in such a way that it by mistake or intentionally is unlocked without this being obvious.

An example of a machine safeguard of this type is shown in protected by the applicant by the patent EP 2 602 407 B1, wherein a series of grating sections (wall elements) are mounted between upright standing posts of steel. At the lower end area of respective grating section there are protrusions on each side facing the respective posts, which protrusions are receivable in a respective recess in the respective brackets arranged at nearby posts. Since the protrusions are placed far below the center of gravity of the wall section, it is impossible for the wall section to take a stable equilibrium position, and it may therefore not be unlocked without being obvious that the wall section is unlocked, since it falls out from the stable equilibrium position which is aligned with the posts. In the locked position of the wall section a lock device, which is arranged at the upper parts of the outer edges of the wall section, has been brought into the corresponding recesses in brackets arranged at the upper end of nearby posts and thereby been snapped into position, from which the lock device may not be unlocked without the use of a special tool. This solution is proven to be very good and safe for most applications regarding machine safeguards and the assembly of the system (the posts and the wall grating sections/elements) is quite easy and swift.

For some applications there is a need of improved strength of the complete system with an even higher demand on for example impact strength, despite the very high strength of the system described in EP 2 602 407 B1.

SUMMARY OF INVENTION

An object of the present invention is to provide an alternative lower bracket with an improved impact strength as well as an easy mounting of a wall element between upright standing posts of steel.

A further object is to provide system for shielding of and area. These objects of are met by a bracket according to claim 1 and a system according to claim 10.

According to an aspect, a bracket arranged for supporting a wall element is disclosed. The wall element is to be arranged between two posts, and the bracket is arranged for attachment to one of two posts. The bracket is further arranged for interaction with a protrusion arranged on a side of a wall element for supporting a wall element between two posts. The bracket being tube-shaped and comprises a front part, a back part arranged opposite the front part, a first side part extending between the front part and the back part, and a second side part extending between the front part and the back part and arranged opposite the first side part, thereby forming a tube extending in a longitudinal direction. The bracket is arranged to enclose a post in a mounted position thereon and at least one of the parts of the bracket comprises locking means for locking the bracket to the post. Further, at least one of the first and second side parts comprises a slit which comprises a receiving section which is open in direction towards the front part and which is arranged for receiving a protrusion of a wall element. The slit comprises a locking section arranged for keeping a protrusion of a wall element when received in the receiving section in a locked position. The locking section is arranged at a first distance from the receiving section in a first direction along the longitudinal direction and the slit further comprises a guiding section, which is arranged between the receiving section and the locking section in the first direction. The guiding section is arranged for guiding a protrusion of a wall element from the receiving section to the locking section.

Such a solution prevents a protrusion of a wall element from leaving the slit in any other direction than in direction towards the guiding section. By having a receiving section which is open towards the front part and a locking section which is arranged at a distance from the receiving section along the longitudinal direction, it is to be understood that the locking section is arranged at another "level" in the longitudinal direction. Thus, the protrusion is prevented from leaving the slit in the front direction, the back direction and in the first direction. A machine safeguard arranged with a bracket according to the invention, for supporting a wall element arranged between two posts, is safer and more robust compared to prior art solutions. For example, if a machined heavy detail is dropped by the machine or a robot which works on the inside of the machine safeguard, a sudden impact from a heavy load effects the wall element, which in prior art solutions sometimes causes a lower protrusion of a wall element to leave the lower bracket. This, since the design of the bracket doesn't prevent the protrusion from leaving its locked position in any direction. Even if the wall element is locked at its upper connection (protrusion and upper bracket) the lower end may loosen since a bending of the wall element causes the lower protrusion to leave its bracket. This is prevented by the new and inventive design of the bracket according to the invention, since the lower protrusion is prevented from leaving the slit for example upwards (if the posts are upright), forwards and backwards. Since the upper end of the wall element in a system with the inventive lower bracket (see further below) is locked, the protrusion is also prevented from leaving the slit in direction towards the guiding section until the upper end is unlocked.

According to an embodiment, the at least one of the first and second side parts which comprises the slit further comprises a stop, which protrudes from the at least one of the first and second side parts which comprises the slit in direction away from the opposite side part of the first and second side part. The stop is arranged at a front side of the at least one of the first and second side part that comprises the slit, which front side faces the front part of the bracket. The stop is further arranged at a second distance from the receiving section along the longitudinal direction. The stop may be arranged on either side of the slit along the longitudinal direction, and by being arranged at the front side of the side part is understood that the stop strengthens the function of preventing the wall element and by that the protrusion from moving in the front direction. The wall element is to be arranged behind the stop and since the protrusion of the wall element engages with the slit arranged at the side part, it is understood that the stop may function both as a support to the frame when mounting the wall element between the posts and also as a support for the frame which guides/pushes the protrusion towards the locking position such as a lifting movement of the wall element is achieved from the receiving section along the guiding section to the locking section, upon pivoting the wall element forwards while resting on the stop. In the locked position the stop abuts the frame of the wall element why the wall element is robustly kept in the lower bracket in the locking section.

According to an embodiment, the locking section of the slit is arranged to prevent the protrusion of the wall element from leaving the slit in direction towards the front part, towards the back part and in the first direction, by that the slit is at least semi-circular at the locking section such as the locking section only is open towards the guiding section. Of course, other design of the slit is possible, but the semi-circular shape is proper for both the function of keeping the protrusion in the locked position as well as an easy receiving of the protrusion from the guiding section to the locking section.

According to an embodiment, the stop is arranged at the second distance from the receiving section of the slit in a second direction along the longitudinal direction. The second direction is an opposite direction of the first direction and the first and second side parts comprises an intermediate part arranged between the receiving section of the slit and the stop. The second distance and the arrangement of the stop in the opposite direction is correlated with the thickness of the frame and the positioning of the protrusion on the frame, such as an easy mounting by the pivoting motion of the wall element is provided. The pivoting movement by using the stop as support makes it easy to introduce the lower protrusion of the wall element into the receiving section of the slit.

According to an embodiment, the guiding section comprises curved portions. This, to enable a smooth and easy mounting of the wall element by a smooth guidance of the protrusion from the receiving section to the locking section of the slit.

According to an embodiment, the at least one of the first and second side parts which comprises the slit comprises a hook-shaped part which at least partly encloses the locking section of the slit so that the protrusion of the wall element is prevented from leaving the slit in direction towards the front part, the back part and in the first direction.

According to an embodiment, the front part of the bracket is fixedly attached to the intermediate part of the first and second side parts. Further, the fixed attachment between the front part and the intermediate part has an extension in the longitudinal direction which extension is smaller than the second distance between the receiving section of the slit and the stop. This to enable an easy introduction of the protrusion of the wall element into the slit without the front part interfering the motion.

According to an embodiment, the stop protrudes a third distance from the first and/or second side parts in direction away from the opposite side part. The third distance is designed to be a proper support for the frame of the wall element and the third distance is preferably correlated with the width of the frame.

According to an embodiment, the first and second side parts each comprises a rear portion and a front portion wherein the respective rear portion is fixedly attached to the back part of the bracket and the respective front portion is fixedly attached to the front part of the bracket. The respective front portion comprises a respective slit, and a distance between the front portions of the respective side part exceeds a distance between the rear portions of the respective side part. The rear portions are arranged to enclose the post by having slightly larger distance between them compared to the cross-section dimension of the post. Since the distance between the front portions of the respective side part exceeds a distance between the rear portions of the respective side part, there is formed a gap between the post and the front portions. This gap is arranged for an end or a head of the protrusion of the wall element.

According to an aspect, a system for shielding an area is disclosed. The system comprises a wall element, having a frame arranged with at least two lower protrusions, which are arranged on opposite sides of the frame and extending in opposite directions, and at least two upper protrusions arranged on opposite sides of the frame and extending in opposite directions. The system further comprises at least two posts extending in a longitudinal direction, between which posts the wall element is to be arranged, an upper bracket provided on respective one of the at least two posts in an upper position. The upper bracket encloses the post at the upper position. The system further comprises a lower bracket according to any of the preceding embodiments, provided on respective one of the at least two posts in a lower position, wherein the lower bracket encloses the post at the lower position. The wall element is arrangeable between the posts by that, on the respective lower bracket, the receiving section of the slit is arranged for receiving the lower protrusion of the wall element, which protrusion faces the lower bracket. The guiding section of the slit is arranged for guiding the lower protrusion from the receiving section to the locking section of the slit, and the locking section is arranged for keeping the lower protrusion of the wall element in a locked position. Further, the respective upper bracket is arranged for snapped connection with the upper protrusion of the wall element which protrusion faces the upper bracket.

Such a system is safer and more robust compared to prior art solutions since when the wall element is locked in the locked position, the upper end of the wall element is locked to the upper bracket and the lower end of the wall element is locked in the lower bracket, in its locking section. By that, the wall element may not loosen from the brackets even if a heavy impact is projected at any part of the wall element. Prior art solution might for example detach from the lower bracket and by that the shielding function is not fully safe. Further, if the upper end is unlocked, for example by means of a special tool or the like, the wall element gets an unstable positioning since it only rests at the lower bracket which is arranged below the center of gravity of the wall element. The wall element most likely falls out and it is obvious that the shield is not fully functioning.

According to an embodiment, the stop of the respective lower bracket is arranged to support the frame of the wall element between the posts such as the respective lower protrusion of the wall element is guided to the receiving section of the slit of the lower bracket and further guided to the locking section via the guiding section of the slit, upon pivoting the wall element from a mounting position in which the wall element has an extension in a direction which differs from the longitudinal direction of the posts to a locked position in which the wall element has an extension along the longitudinal direction of the post, wherein the movement of the protrusion from the receiving section to the locking section of the slit causes a lifting movement of the wall element in the longitudinal direction, wherein the upper protrusion of the wall element comes into position of the upper bracket arranged at the post ready for snap-connection with the upper bracket. In the locked position of the wall element between the posts the respective upper bracket is in snapped connection with the respective upper protrusion of the wall element. When mounting the wall element between the posts the stop functions as a support to the frame in a first mounting position. Further, since the frame upon pivoting the wall element forwards when resting on the stop, enters more and more behind the stop, the frame guides/pushes the protrusion towards the locking position of the slit in the bracket, and since the protrusion of the wall element engages with the slit it is understood that the stop functions both as a support to the frame when mounting the wall element and also as a support for the guiding of the protrusion in the slit. By the pivoting motion of the wall element while supported by the stop a lifting movement of the wall element is achieved in which the protrusion moves from the receiving section along the guiding section to the locking section. In the locked position the stop abuts the frame of the wall element why the wall element is robustly kept in the lower bracket in the locking section.

According to an embodiment, a distance between the stop and the guiding section of the slit in a direction transverse the longitudinal direction, that is along the side parts, is correlated with a distance from the lower protrusion to a front side of the frame of the wall element, so that the lower protrusion is guided from the receiving section to the locking section via the guiding of the slit, upon pivoting the wall element from the mounting position to the locked position between the posts.

According to an embodiment, a gap is arranged between the front portion of the bracket and the post. The gap is arranged to receive an end of the protrusion of the wall element.

According to an embodiment, at least the lower protrusion of the wall element is a rivet with a head and a body wherein the body is arranged to fit in the slit of the lower bracket and the head is arranged to fit in the gap between the front portion of the lower bracket and the post. This head of the rivet prevents the protrusion from leaving the slit in direction away from the post.

BRIEF DESCRIPTION OF DRAWINGS

The invention is now described, by way of example, with reference to the accompanying drawings, in which:

FIG. 4*a* shows an isometric zoomed view of the inventive bracket mounted on a post and a part of a wall element ready for interaction with the bracket.

FIG. 4*b-c* show an isometric view and a front view of the inventive bracket mounted on a post and where a wall element is supported by the bracket.

FIG. 5*a-c* show side views of the bracket arranged on a post and the assembly of a wall element to the bracket.

FIG. 7*a* shows an isometric zoomed view of an upper bracket of FIG. 1.

FIG. 7*b-c* show isometric views from opposite sides of the upper bracket of FIG. 7*a*.

DESCRIPTION OF EMBODIMENTS

In the following, a detailed description of a mounting bracket 1 according to the invention is disclosed in detail in respect of embodiments and in reference to the accompanying drawings. All examples herein should be seen as part of general description and therefore possible to combine in any way in general terms.

Figure 1:
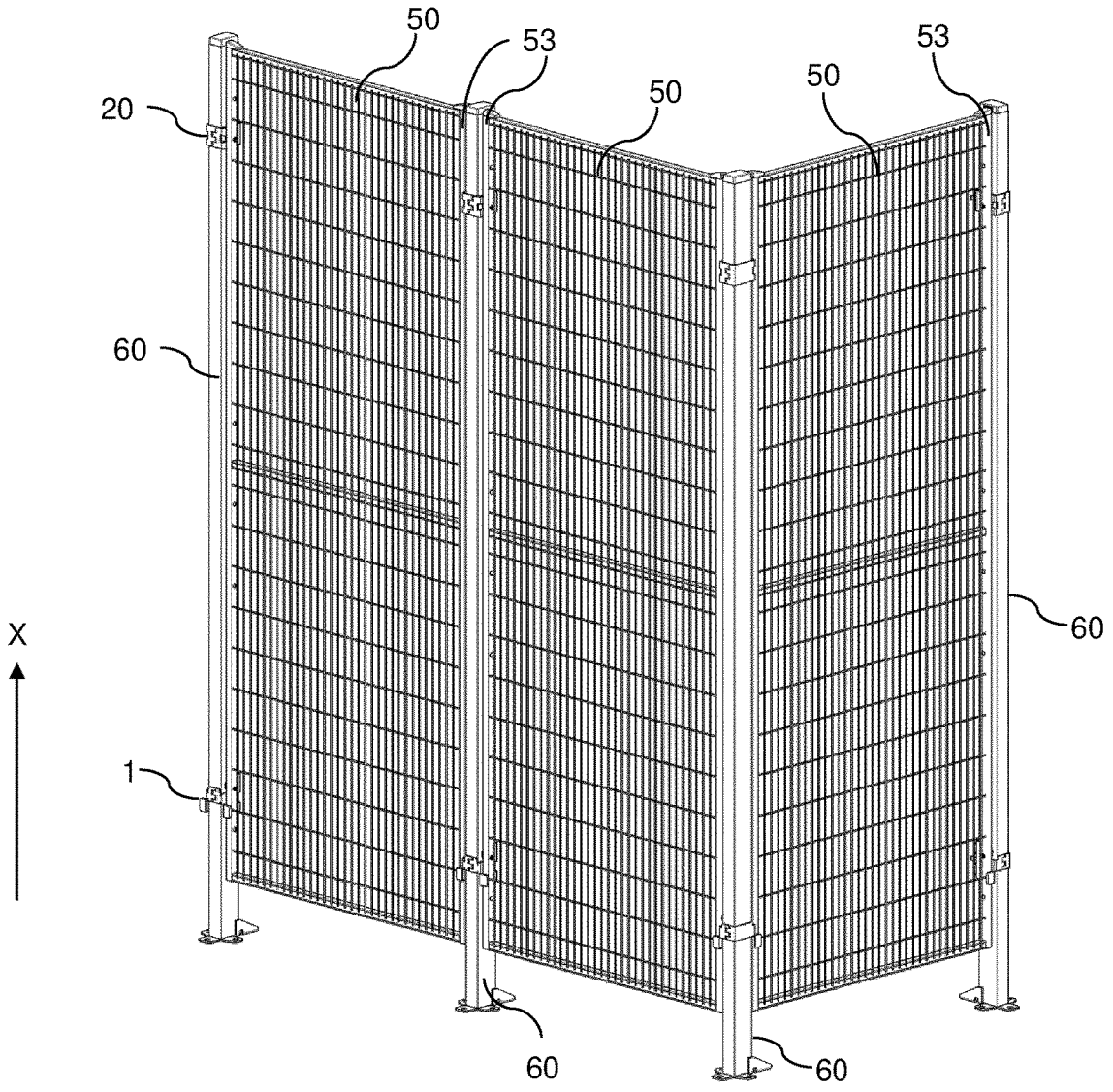
FIG. 1 shows an isometric view of a system for shielding an area in which a number of wall elements with gratings is mounted between a number of supporting posts.

FIG. 1 shows a part of a system for shielding an area, for example for use as a machine safeguard or the like. The system is typically seen to be used in an industrial room, even if numerous other applications are possible. The part of the system in FIG. 1 comprises a number of upright posts 60. The posts 60 in the preferred embodiment are manufactured of metal, typical seen robust sheet metal, which has been given a rectangular cross section. The posts 60 are thereafter given a surface treatment in an optional way, such as galvanization or lacquering. At the lower end of each post 60 anchor means is provided for anchoring the posts 60 in a foundation, for example a floor. At the upper end of each post 60 is provided an end means, which encloses the upper end of the pole to prevent dirt from accumulating inside the post. Between each pair of posts 60 there is provided a wall element 50, which in this case are grating sections, which have an outer frame 53 provided along its edges. The frame 53 gives stiffness to the grating, which in the preferred embodiment is manufactured of metal, and functions also as arrangement for protrusions (not visible) arranged for the attachment of the wall elements 50 at the posts 60. Even if FIG. 1 shows wall elements 50 with gratings it is of course possible to use other materials, for example transparent or colored plastics, which furthermore may protect against splash and spread of particles. The frame 53 of the wall element 50 is arranged with at least two lower protrusions (not visible) arranged on opposite sides of the frame 53 and extending in opposite directions, and at least two upper protrusions (not visible) arranged on opposite sides of the frame 53 and extending in opposite directions.

Around each one of the posts 60 shown in FIG. 1 it is provided an upper bracket 20 and a lower bracket 1. The brackets 1, 20 encircles the post and is positioned in an optional position along the pole, this since the post 60 in the preferred embodiment has a substantial constant cross section. To position the respective lower and upper bracket 1, 20 in a fixed position it is only demanded that the bracket 1, 20 is tightened by means of a locking means (not visible). Thus, no making of holes or other machining of the post 60 is needed in the appropriate position. To achieve a maximal freedom of choice concerning the position of the brackets 1, 20, there is provided a series of holes in the same way on the frame 53 of the wall elements 50, such as the frame 53 may be provided with interacting protrusions in these positions.

Figure 2A:
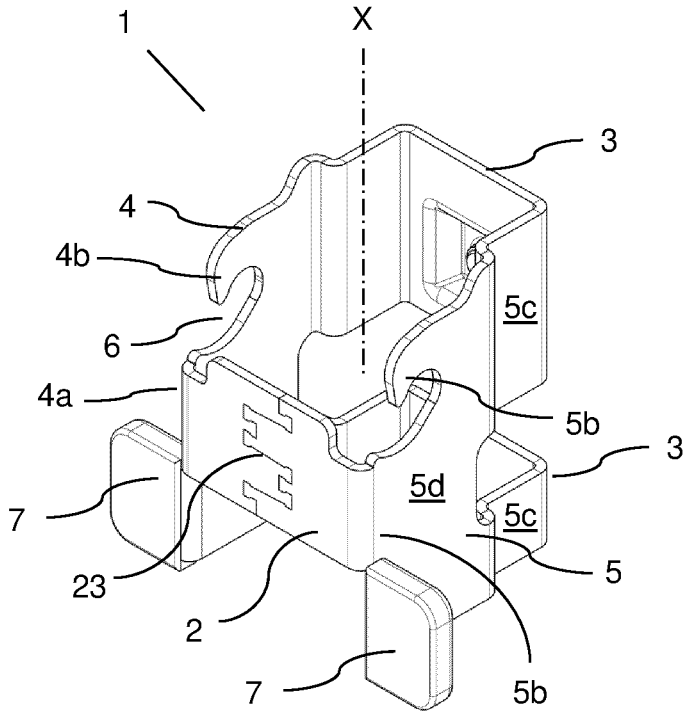
FIG. 2*a-b* show isometric views from opposite sides of a bracket according to the invention, which bracket is a lower bracket visible to the left and right as well on the mid post in FIG. 1.
Figure 2B:
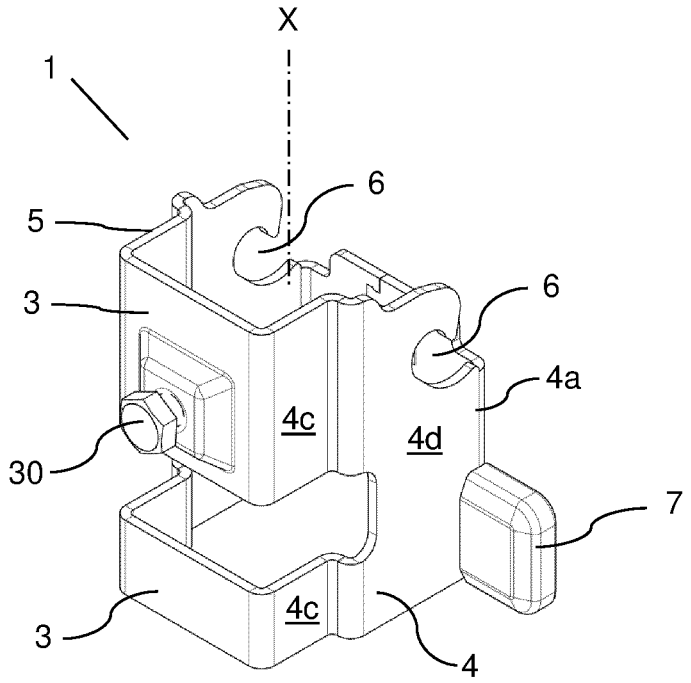

FIG. 2*a-b* show isometric views from opposite sides of the lower bracket 1 according to the invention. The bracket 1 is as mentioned above arranged for supporting the wall element 50 when arranged between two posts 60 as visible in FIG. 1 and thus, the bracket 1 is tube-shaped to fit as an encircling bracket 1 around the post 60 and preferably, the cross-section is substantially rectangular and dimensioned such as possible to introduce the bracket 1 around the post 60 from an end of the post. The bracket 1 comprises a front part 2, which in FIG. 2*a* faces the viewer, and which preferably is provided with a joint 23 which is shaped like a dove tail. The joint 23 is strong, not least because the joint 23 has been given a shape with varying widths on interacting protrusions in the joint 23. This gives an undercutting in relation to a thought dismounting direction in the plane. Those parts of the joint 23 which extend along the longitudinal direction of the bracket 1 are divided into shorter distances, which are sideways displaced in relation to each other. They are accordingly not placed along one single straight line, but are provided on at least four, substantially parallel lines. This gives a particular resistance to that the joint 23 will break up by bend of this wall of the bracket 1. The bracket 1 further comprises a back part 3 which is arranged opposite the front part 2, and further a first side part 4 which extends between the front part 2 and the back part 3 and a second side part 5 which extends between the front part 2 and the back part 3 and arranged opposite the first side part 4. These parts 2, 3, 4, 5 forms a tube which extends in a longitudinal direction X. The back part 3 comprises locking means 30 for locking the bracket 1 to the post 60 in any position along the post 60. The locking means 30 may for example be a tensioner in the form of a bolt which is to be screwed in direction towards the post until an end of the bolt will get into contact with the post on which the bracket 1 is mounted. The back side 3 is in the preferred embodiment divided into an upper and a lower part and the locking means 30 is according to the embodiment arranged at the upper part.

According to a preferred embodiment at least one of the first and second side parts 4, 5 comprises a slit 6 for receiving a protrusion 51 (not visible, see FIG. 4*a-c*) arranged on the frame 53 of the wall element 50. In the embodiment of FIG. 2*a* the bracket 1 comprises one slit 6 per side part 3, 4, and first and second side parts 4, 5 further comprise a hook-shaped part 4*b*, 5*b* which is directed towards the front part 2. The first and second side parts 4, 5 each comprises a rear portion 4*c*, 5*c* (or rear portions since the end part 3 is divided) and a front portion 4*d*, 5*d*. The respective rear portion 4*c*, 5*c* is fixedly attached to the back part 3 of the bracket 1 and the respective front portion 4*d*, 5*d* is fixedly attached to the front part 2 of the bracket 1. In the preferred embodiment the respective front portion 4*d*, 5*d* comprises the slit 6. The rear portions 4*c*, 5*c* is arranged with a slightly larger distance between each other compared to dimension of the cross-section of the post 60 on which the bracket 1 is to be arranged.

The first and second side parts 4, 5 further comprises a respective stop 7 which protrudes from the respective side part 4, 5 in direction away from the opposite side part 4, 5 at a front side 4*a*, 5*a* of the respective first and second side parts 4, 5. The front sides 4*a*, 5*a* of the respective side parts 3, 4 faces the front part 2 of the bracket 1.

Figure 3A:
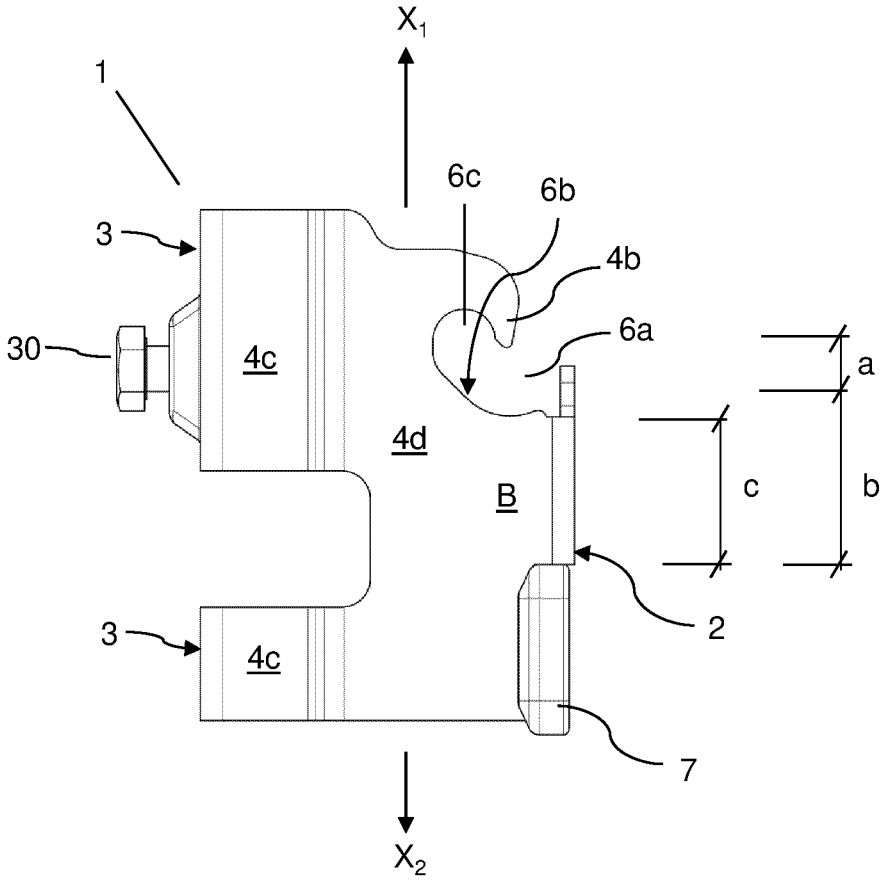
FIG. 3*a-b* show a side view and a top view of the bracket of FIG. 2*a-b*.

FIG. 3*a* show a side view of the bracket 1 of FIG. 2*a-b*. The first side part 4 faces the viewer and will hereby be described, but it is to be understood that the second side view 5 is a mirror-copy of the first side view 4 according to this embodiment. In the figure the back part 3 is directed to the left and the upper part of the back part 3 comprises the locking means 30 in the form of a bolt, which is arranged to be screwed into the bracket (to the left) to finally engage with an inner lying post (not visible). The upper part of the rear part 3 is fixedly attached to the upper part of the rear portions 4*c* of the first side portion 4, and the lower part of the back part 3 is fixedly attached to the lower part of the rear portions 4*c* of the first side portion 4. The front portion 4*d* of the first side position comprises the slit 6 and the hook-shaped part 4*b*. The slit 6 comprises a receiving section 6*a* which is open in direction towards the front part 2. The receiving section is arranged to receive a protrusion 51 of a wall element 50 (not visible, see FIG. 5*a-c*). The slit 6 further comprises a locking section 6*c* which is arranged to keep a protrusion 51 of a wall element 50 in a locked position, when received in the receiving section 6*a*. The locking section 6*c* is arranged at a first distance a, from the receiving section 6*a*, in a first direction $X_1$ along the longitudinal direction X. The slit 6 further comprises a guiding section 6*b* which is arranged between the receiving section 6*a* and the locking section 6*c* seen in the first direction $X_1$. Preferably, the slit 6 is at least semi-circular at the locking section 6*c* such as the locking section 6*c* only is open towards the guiding section 6*b*. The guiding section 6*b* is arranged to guide a protrusion 51 of a wall element 50 from the receiving section 6*a* to the locking section 6*c* and the guiding section 6*b* may comprise curved portions and or straight and curved portions, depending on the positions of the receiving section 6*a* relative the locking section 6*c*.

The stop 7 is arranged at a second distance b from the receiving section 6*a* along the longitudinal direction X. The stop 7 could be arranged in the first direction $X_1$ which in the figure would be above the slit 6, but it is preferred that the stop 7 is arranged at the second distance b from the receiving section 6*a* of the slit 6 in a second direction $X_2$ along the longitudinal direction X, which second direction $X_2$ is an opposite direction of the first direction $X_1$. The reason for this will be explained below in relation to the FIG. 5*a-c*.

The first and second side parts 4, 5 comprises an intermediate part B which is arranged between the receiving section 6*a* of the slit 6 and the stop 7*a* and the front part 2 of the bracket 1 is fixedly attached to the intermediate part B wherein the fixed attachment between the front part 2 and the intermediate part B has an extension c in the longitudinal direction X. It is preferred that this extension c is smaller than the second distance b between the receiving section 6*a* of the slit 6 and the stop 7, since it is important that the front part 2 does not interfere with the receiving section 6*a* of the slit, when introducing the protrusion 51 into the slit 6.

Figure 3B:
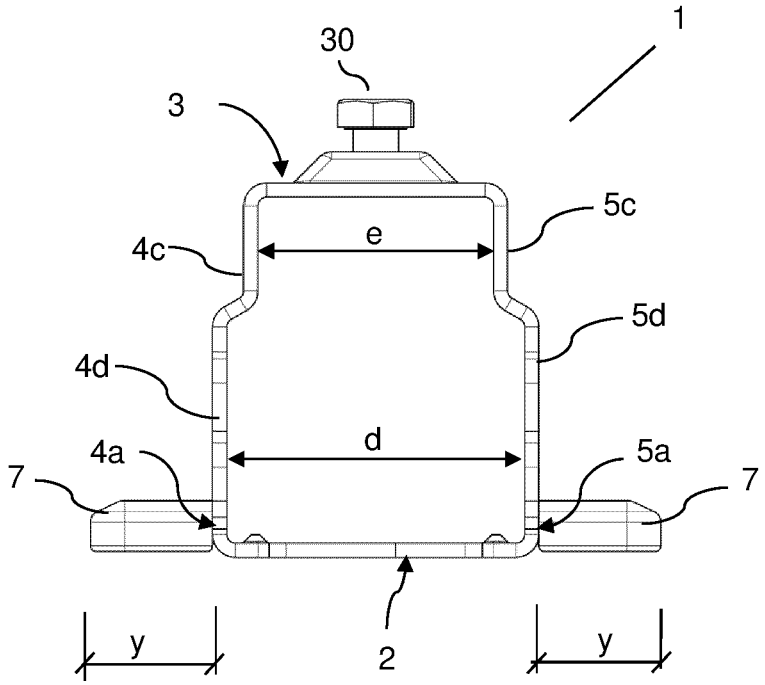

FIG. 3*b* is a top view of the bracket 1 of FIG. 2*a-b*. The rear portions 4*c*, 5*c* is arranged with a distance e between each other, which distance is slightly larger compared to dimension of the cross-section of the post 60 on which the bracket 1 is to be arranged. Thus, the rear portions 4*c*, 5*c* is arranged to abut or almost abut the outer sides of the post 60. As can be seen in FIG. 3*b*, a distance d between the front portions 4*d,* 5*d* of the respective side part 4, 5 exceeds the distance e between the rear portions 4*c,* 5*c* of the respective side part 4, 5. This means that a gap is arranged between the front portion 4*d,* 5*d* of the bracket 1 and the post, see FIGS. 4*a* and 4*c*, which is necessary for introducing an end of the protrusion 51 of the wall element 50. Further, the stop 7 protrudes a third distance y from the first and second side parts 4, 5, i.e. from the front portions 4*d,* 5*d,* in direction away from the opposite side part 4, 5 and the distance y is chosen in correlation with the dimensions of the frame part 53 of the wall element 50 (see explanation below).

FIG. 4*a* shows an isometric zoomed view of the inventive bracket 1 mounted on a post 60 and a part of one wall element 50 (to the right) ready for interaction with the bracket 1. The front part 2 of the bracket 1 faces the viewer and the stops 7 on the left and right sides of the post 60 substantially aligns with the front part 2 of the bracket 1. Above the stops 7, at the first and second side parts 4, 5 the respective slit 6 may be seen and between the post 60 and the respective side part 4, 5 a respective gap 8 may bee seen. The gap 8 is necessary to be able to introduce at least a top of the protrusion 51, which is arranged at the frame 53 of the wall element 50. At least the lower protrusion 51, but preferably also an upper protrusion 52 (see FIG. 7*a*) of the wall element 50 is a rivet with a head 55 and a body 56, wherein the body 56 is arranged to fit in the slit 6 of the lower bracket 1 and the head 55 is arranged to fit in the gap 8 between the front portion 4*d,* 5*d* of the lower bracket 1 and the post 60.

FIG. 4*b-c* show an isometric view and a front view of the inventive bracket 1 mounted on a post 60 and where a wall element 50 is arranged in a locked position on the respective sides of the post 60. As mentioned above the slit 6 is arranged for receiving a lower protrusion 51 of the wall element 50 which protrusion 51 faces the lower bracket 1. In FIG. 4*b-c* the respective lower protrusion 51 arranged on the respective frame 53 of the left and right wall element 50 is engaged with the bracket 1 in the locking position (i.e. the locking section 6*c* of the slit 6), wherein the protrusions 51 are prevented from leaving the slit 6 in any other direction than downwards referring to the longitudinal (upright) direction X of the post 60. By that the respective upper bracket 20 is arranged for snapped connection with upper protrusions 52 of the respective wall element 50 which upper protrusions 52 faces the upper bracket 20, the lower protrusions 51 is prevented from leaving the slit 6 of the lower bracket 1 also in the open direction, that is downwards along the longitudinal direction X. The stop 7 on each side of the front part 2 of the bracket 1 also prevent a movement of the wall element in direction towards the front 2. The total solution is very strong and prevents the wall element 50 from loosening from the lower brackets 1. As mentioned above, the lower protrusion 51 and preferably the upper protrusion 52 (not visible) is a rivet with a head 55 and a body 56 and the head 55 is as seen in FIG. 4*c* fitted in the gap 8 between the front portion 4*d,* 5*d* of the lower bracket 1 and the post 60.

FIG. 5*a-c* show side views of the bracket 1 arranged on a post 60 and the assembly steps when assembling a wall element 50 to the bracket 1, according to the invention. The bracket 1 is fixedly arranged on the post 60 by the locking means 30, as described above. The tube-shaped bracket 1 is arranged with the second side part 5 towards the viewer and the front part 5*d* which comprises the slit 6 is arranged in the first direction $X_1$ along the post 60 and the front part 5*d* which comprises the stop 7 is arranged in the opposite second direction $X_2$.

The first step is to introduce a wall element 50 with its frame 53 between two posts 60 from the front direction, which is from left to right in the figures or from the front part 2 towards the back part 3. In FIG. 5*a-c*, one post 60 with one lower bracket 1 is visible as well as a "transparent" frame 53 of a wall element. The frame 53 is shown as transparent to better show the function when arranging the wall element 50 in a supported position between the posts 60. A lower protrusion 51 is arranged at the frame 53 on a side which faces the bracket 1 as well as faces the post 60. The frame 53 is positioned on opposite stops 7 positioned on lower brackets 1 on the two posts 60 between which posts the wall element 50 is to be supported. Thus, the stops 7 are arranged on opposite sides of the frame 53 and facing each other. When positioned the frame 53 on the stops 7, the frame 53 is tilted forward in direction towards the posts 60, such as the protrusion 51 on respective sides of the frame 53 approaches the slit 6. The respective protrusion 51 is guided towards the receiving section 6*a* of the slit 6 by the pivoting motion until the respective protrusion 51 enters the receiving section 6*a*. A distance between the stop 7 and the guiding section 6*b* of the slit 6, in a direction transverse the longitudinal direction X, (that is along the side parts 4, 5), is correlated with a distance from the lower protrusion 51 to a front side of the frame 53 of the wall element 50, so that the lower protrusion 51 is guided from the receiving section 6*a* to the locking section 6*c* via the guiding 6*b* of the slit 6, upon pivoting the wall element 50 from a mounting position (FIG. 5*a*) to the locking position (FIG. 5*c*). The interaction between the stop 7 and the frame 53 of the wall element 50 so to speak pushes the protrusion along the guiding section 6*b* upon pivoting the wall element 50 from a mounting position, in which the wall element 50 has an extension in a direction which differs from the longitudinal direction X of the posts 60, to a locked position in which the wall element 50 has an extension along the longitudinal direction X of the posts 60, that is until the wall element 50 aligns with the posts 60. This means that the pivoting motion of the wall element 50, while the wall element 50 is supported by the stop 7, causes a lifting movement of the wall element 50 by that the protrusion 51 moves from the receiving section 6*a* along the guiding section 6*b* to the locking section 6*c* of the slit 6. In the aligned position of the wall element 50 relative the posts 60, the upper bracket 20 (se further FIG. 7*a-c*) locks the upper protrusion 52 of the wall element with a snap connection. In this aligned position of the wall element 50 and the posts 60, the lower protrusion 51 is kept in the locked position in the locking section 6*c* of the slit 6, which is at a level above the receiving section 6*a*. The locking section 6*c* of the slit 6 is as mentioned above arranged to prevent the protrusion 51 of the wall element 50 from leaving the slit 6 in direction towards the front part 2, towards the back part 3 and in the first direction $X_1$, by that the slit 6 is semi-circular such as the locking section 6*c* only is open towards the guiding section 6*b,* which in the preferred embodiment is open substantially downwards. Preferably the first and second side part 4, 5 comprises the hook-shaped part 4*b*, 5*b* which at least partly encloses the locking section 6*c,* to facilitate the function.

Figure 6A:
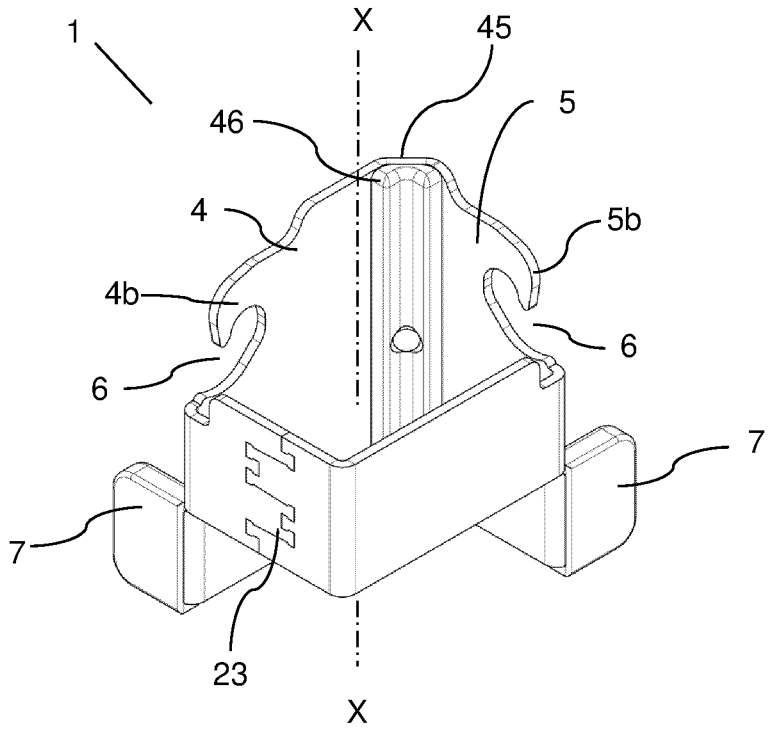
FIG. 6*a-b* show isometric views from opposite sides of an alternative bracket according to the invention, which bracket is a lower corner bracket visible in FIG. 1.
Figure 6B:
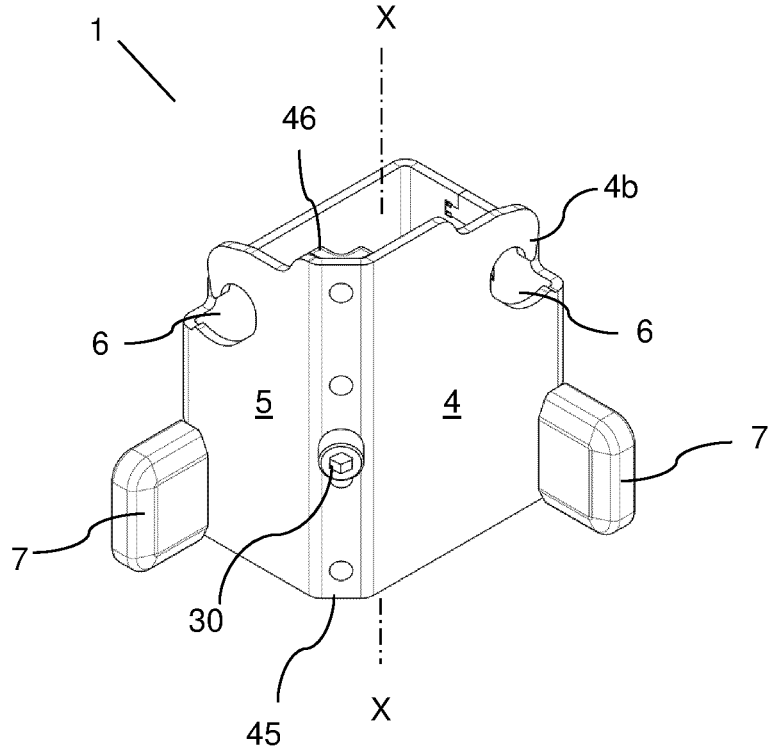

FIG. 6*a-b* show isometric views from opposite sides of an alternative bracket 1 according to the invention, which bracket 1 is a lower corner bracket 1 visible in FIG. 1. The functionality is the same as the above described embodiment, but the first and second side parts 4, 5 are instead arranged on a respective side of a corner 45. The corner 45 further comprises a spacer 46 which provides a gap corresponding to the gap 8 of the above embodiment, between the post and the side parts 4, 5. The stop 7 as well as the slit 6 and hook part 4*b*, 5*b* is arranged at respective side parts 4, 5 and function the same way. The locking means 30 is preferably arranged at the corner 45 and is arranged to engage with the corner of the post.

FIG. 7*a* shows an isometric zoomed view of an upper bracket 20 of FIG. 1 and FIG. 7*b-c* show isometric views from opposite sides of the upper bracket 20 of FIG. 7*a*. In the figure the upper bracket 20 is shown more clearly and the upper bracket 20 encircles the post 60 in a similar way as the lower bracket 1. The upper bracket 20 is also tube-shaped and comprises a front part 22 and an opposite back part 23. Between the front part 22 and the back part 23 a first side part 24 and a second side part 25 extends. The back part 23 comprises a locking means 30 with a similar function as at the lower bracket 1.

The upper bracket 20 further comprises snap-lock means, which consists of an inner part 26 and an outer part 27, and which connects the upper bracket 20 with the frame 53 of the wall element 50, by that the upper protrusions 52 arranged on the frame 53 snaps with the snap-lock means 26, 27 when the wall element 50 aligns with the posts 60. The outer part 27 of the lock means may not be released without any particular influence from a particular influencing means, which in the shown embodiment is taken up in the hole 28, to unlock the snap-lock means and thereafter unfasten the wall element 50. In the shown embodiment it is intended to only unlock the lock means from the inside of the machine safeguard, since opening from the outside can be considered as insufficiently safe.

The invention claimed is:

1. A bracket arranged for supporting a wall element to be arranged between two posts, wherein the bracket is arranged for attachment to one of the two posts, and the bracket is further arranged for interaction with a protrusion arranged on a side of the wall element for supporting the wall element between two posts, the bracket being tube-shaped and comprising:

a front part, a back part arranged opposite the front part, a first side part extending between the front part and the back part, a second side part extending between the front part and the back part and arranged opposite the first side part thereby forming a tube extending in a longitudinal direction, wherein the bracket is arranged to enclose the post in a mounted position thereon, and wherein at least one of the parts of the bracket comprises a locking means for locking the bracket to the post, wherein at least one of the first and second side parts comprises a slit which comprises a receiving section which is open in a direction towards the front part and which is arranged for receiving the protrusion of the wall element, and the slit further comprises a locking section arranged for keeping the protrusion of the wall element in a locked position following receipt of the protrusion in the locking section, wherein the locking section is arranged at a first distance from the receiving section in a first direction along the longitudinal direction, and the slit further comprises a guiding section arranged between the receiving section and the locking section in the first direction, which guiding section is arranged for guiding the protrusion of the wall element from the receiving section to the locking section, wherein the at least one of the first and second side parts which comprises the slit further comprises a stop which protrudes from the at least one of the first and second side parts which comprises the slit in a direction away from the opposite side part of the first and second side parts, and which stop is arranged at a front side of the at least one of the first and second side parts that comprises the slit, which front side faces the front part of the bracket, and wherein the stop further is arranged at a second distance from the receiving section in a second direction along the longitudinal direction opposite the first direction and the stop having a stop surface that faces the back part, wherein the stop surface engages a structural part of the wall element when the protrusion is in the locked position following pivoting of a lower portion of the wall element in a direction toward the stop surface.

2. The bracket according to claim 1, wherein the locking section of the slit is arranged to prevent the protrusion of the wall element from leaving the slit in a direction towards the front part, towards the back part and in the first direction, wherein the slit is at least semi-circular at the locking section such that the locking section only is open towards the guiding section.

3. The bracket according to claim 1, wherein the first and second side parts comprise an intermediate part arranged between the receiving section of the slit and the stop.

4. The bracket according to claim 3, wherein the front part of the bracket is fixedly attached to the intermediate part of the first and second side parts, wherein the fixed attachment between the front part and the intermediate part has an extension in the longitudinal direction which extension is smaller than the second distance between the receiving section of the slit and the stop.

5. The bracket according to claim 1, wherein the guiding section comprises curved portions.

6. The bracket according to claim 1, wherein the at least one of the first and second side parts which comprises the slit comprises a hook-shaped part which at least partly encloses the locking section of the slit so that the protrusion of the wall element is prevented from leaving the slit in direction towards the front part, the back part and in the first direction.

7. The bracket according to claim 1, wherein the stop protrudes a third distance from the first and/or second side parts in direction away from the opposite side part.

8. The bracket according to claim 1, wherein the first and second side parts each comprises a rear portion and a front portion wherein the respective rear portion is fixedly attached to the back part of the bracket and the respective front portion is fixedly attached to the front part of the bracket, and the respective front portion comprises a respective slit, and a distance between the front portions of the respective side part exceeds a distance between the rear portions of the respective side part.

9. A system for shielding an area, the system comprising:

a wall element, having a frame arranged with at least two lower protrusions arranged on opposite sides of the frame and extending in opposite directions, and at least two upper protrusions arranged on opposite sides of the frame and extending in opposite directions, at least two posts extending in a longitudinal direction, between which posts the wall element is to be arranged, an upper bracket provided on each respective one of the at least two posts in an upper position, the upper bracket enclosing the post at the upper position, a lower bracket according to claim 1 provided on each respective one of the at least two posts in a lower position, the lower bracket enclosing the post at the lower position, wherein the wall element is arrangeable between the posts such that, on the respective lower bracket, the receiving section of the slit is arranged for receiving the lower protrusion of the wall element which protrusion faces the lower bracket, and the guiding section of the slit is arranged for guiding the lower protrusion from the receiving section to the locking section of the slit, and the locking section is arranged for keeping the lower protrusion of the wall element in a locked position, and such that the respective upper bracket is arranged for a snapped connection with the upper protrusion of the wall element which protrusion faces the upper bracket.

10. The system according to claim 9, wherein the stop of the respective lower bracket is arranged to support the frame of the wall element between the posts such as the respective lower protrusion of the wall element is guided to the receiving section of the slit of the lower bracket and further guided to the locking section via the guiding section of the slit, upon pivoting the wall element from a mounting position in which the wall element has an extension in a direction which differs from the longitudinal direction of the posts to a locked position in which the wall element has an extension along the longitudinal direction of the posts, wherein the movement of the protrusion from the receiving section to the locking section of the slit causes a lifting movement of the wall element in the longitudinal direction, wherein the upper protrusion of the wall element comes into position of the upper bracket arranged at the post ready for a snap-connection with the upper bracket, and in the locked position of the wall element between the posts the respective upper bracket is in the snapped connection with the respective upper protrusion of the wall element.

11. The system according to claim 9, wherein a distance between the stop and the guiding section of the slit in a direction transverse the longitudinal direction, that is along the side parts, is correlated with a distance from the lower protrusion to a front side of the frame of the wall element, so that the lower protrusion is guided from the receiving section to the locking section via the guiding of the slit upon pivoting the wall element from the mounting position to the locked position between the posts.

12. The system according to claim 9, wherein a gap is arranged between the front portion of the bracket and the post.

13. The system according to claim 12, wherein at least the lower protrusion of the wall element is a rivet with a head and a body wherein the body is arranged to fit in the slit of the lower bracket and the head is arranged to fit in the gap between the front portion of the lower bracket and the post.

14. The bracket according to claim 1, wherein the stop further comprises an upper surface that engages the structural part during entry of the protrusion into the receiving section and displacement of the wall element along the longitudinal direction during passage of the protrusion through the guide section.

15. The bracket according to claim 1, wherein the first and second distances are coordinated to allow movement of the wall element so that the protrusion is received by the receiving section and guided by the guiding section from the receiving section to the locking section.

* * * * *